US005214354A

United States Patent [19]

Johnson

[11] Patent Number: 5,214,354

[45] **Date of Patent: * May 25, 1993**

[54] ELECTRONIC CONTROL MODULE (ECM) FOR CONTROLLING LIGHTING FUNCTIONS OF A LAMP BULB AND METHOD OF MANUFACTURE

[75] Inventor: Samuel A. Johnson, Eagle, Id.

[73] Assignee: Beacon Light Products, Inc., Meridian, Id.

[ * ] Notice: The portion of the term of this patent subsequent to Jun. 30, 2009 has been disclaimed.

[21] Appl. No.: 847,179

[22] Filed: Mar. 9, 1992

Related U.S. Application Data

[62] Division of Ser. No. 587,997, Sep. 25, 1990, Pat. No. 5,126,634.

[51] Int. Cl.[5] ..... H01J 7/44

[52] U.S. Cl. ..... 315/71; 315/297; 315/208

[58] Field of Search ..... 315/291, 293, 315, 71, 315/DIG. 5, DIG. 7, 69, 297, 208, 70, 360, 32, 72, 209 R, 20 S, 200 R, 64; 323/320, 321

[56] References Cited

U.S. PATENT DOCUMENTS 3,823,339 7/1974 Borneman et al. ..... 315/69
4,988,921 1/1991 Ratner et al. ..... 315/159
5,126,634 6/1992 Johnson ..... 315/71

*Primary Examiner*—Robert J. Pascal
*Assistant Examiner*—Ali Neyzari
*Attorney, Agent, or Firm*—William J. Bethurum

[57] ABSTRACT

A new and improved electronic control module (ECM) for controlling lighting functions of an incandescent light bulb and method of manufacturing the ECM. The ECM is installed, such as by press fitting into a dielectric insulating material at the socket end of the bulb, after the high temperature bulb fabrication steps have been completed. In this manner, the solid state and associated circuitry of the electronic control module are not subjected to the high temperature processing used in lamp bulb fabrication. The electronic control module is especially well suited and adapted for integration into the lamp bulb housing and is constructed using a minimum number of reliably constructed and connected electrical components in a hybrid-type circuit module assembly which is economical to manufacture. In one embodiment of the invention, this module is operative by rotational adjustment to provide lighting function control and selectivity for the bulb, and in both embodiments described herein it is in direct contact with the copper center terminal of an adjoining electrical socket. This feature provides excellent heat sinking for and cooling of the module.

7 Claims, 6 Drawing Sheets

ELECTRONIC CONTROL MODULE (ECM) FOR CONTROLLING LIGHTING FUNCTIONS OF A LAMP BULB AND METHOD OF MANUFACTURE

DIVISIONAL APPLICATION

This application is a divisional of my parent application Ser. No. 07/587,997, entitled "Lamp Bulb With Integrated Bulb Control Circuitry And Method of Manufacture", filed Sep. 25, 1990, now U.S. Pat. No. 5,126,634.

TECHNICAL FIELD

This invention relates generally to the manufacture of incandescent lamp or light bulbs and more particularly to the integration of lighting control circuitry into such bulbs during the manufacturing process therefor. This invention further relates to the electronic control of various lighting functions such as illumination intensity, dimming, timing, duty cycle control and the like.

RELATED APPLICATION

In my U.S. patent application Ser. No. 07/345,214 filed Apr. 28, 1989 and entitled "Two Terminal Incandescent Lamp Controller" there are disclosed and claimed new and useful improvements in the control of various lighting functions such as duty cycle timing, dimming and variations in illumination intensity. These functions are accomplished in this application by the use of a small control module which is adapted for placement into an electrical socket before an incandescent light bulb is inserted therein. The present invention represents still further new and useful improvements in the construction of electronic control modules for the control of the above lighting functions and the novel integration of such modules into the incandescent lamp bulb manufacturing process as will be described below.

BACKGROUND ART

In the manufacture of different types of light bulbs, various designs have been proposed for integrating bulb control circuitry into the manufacturing process so that the circuitry ultimately is located within the bulb itself and provides one or more lamp control functions when the bulb is connected into a mating electrical socket. One such design is disclosed, for example, in U.S. Pat. No. 4,644,226 issued to Vernooij et al. and incorporated herein by reference.

One disadvantage of the Vernooij et al. type of bulb construction method is that the semiconductor control circuitry used to control light bulb operation is mounted within and adjacent to the screw shell base or sleeve of the bulb. This location within the light bulb is not particularly well suited for providing good thermal conductivity and heat transfer away from the control circuitry in order to maximize the overall cooling for the bulb. That is to say, the disclosed control circuitry is positioned within the shell base and so confined therein such that all of the heat generated during control circuit operation is largely confined to the interior of the bulb proper and adds to the heat which is already generated by the other active components therein. The additional heat generated by this integrated control circuitry can be considerable in view of the fact that the thyristor of the circuit alone is capable of generating one watt per ampere of thermal heat.

In addition to the above disadvantage associated with bulb over-heating, the manufacturing process of Vernooij et al. requires that the control circuitry therein be installed within the light bulb during the high temperature processing thereof where the bulb shell base or sleeve member is subjected to elevated temperatures on the order of 800° C. or greater. The exposure of this control circuitry and semiconductor devices connected therein to these high temperature bulb processing steps has a degrading effect on circuit performance as is well known. Furthermore, the necessity for incorporating the semiconductor control circuitry into the shell base and associated glass end piece and center terminal attachment process further complicates the otherwise standard bulb manufacturing process by adding several additional control circuit mounting and bonding steps to the process during the above high temperature processing therefor.

DISCLOSURE OF INVENTION

The general purpose and principal object of the present invention is to provide a new and improved manufacturing process for producing incandescent and other equivalent light bulbs which contain bulb control circuitry integrated therein. This process overcomes the above types of process disadvantages of exposing the control circuitry to high temperature processing and then providing less-than-optimum heat sinking and cooling capability for the control circuitry.

Another object of this invention is to provide a new and improved light bulb and article of manufacture made by the above process.

Another object of this invention is to provide a new and improved electronic control module (ECM) which is especially well suited and adapted for use with and control of incandescent light bulbs.

A further object of this invention is to provide a new and improved electronic control module of the type described which is uniquely adapted for integration into standard light bulb manufacturing processes without exposing the module to high temperature light bulb processing steps or complicating and mixing the bulb processing steps with the novel process disclosed herein for fabricating the electronic control module.

Yet another object of this invention is to provide a new and improved light bulb and associated electronic control module therefor which are both reliable in operation and durable in construction, and may be fabricated using different and independent manufacturing processes.

To accomplish the above purpose and related objects, there has been discovered and developed a new and improved process for manufacturing a circuit-integrated-and-controlled light bulb which includes the steps of: (a) providing a light bulb having a filament wire therein and a dielectric insulator at one end thereof, with the insulator having a recessed cavity therein adjacent to an opening extending to an interior section of the bulb, (b) mounting an electronic control module (ECM) in the receptacle, and (c) connecting the electronic control module (ECM) to the filament wire for thereby controlling one or a plurality of bulb lighting functions in response to the operation of the electronic control module.

A novel feature of this invention is the provision of a new and improved article of manufacture made by the above process which includes, in combination: (a) a light bulb having a filament wire therein and a dielectric insulator with a recessed cavity adjacent to an opening in the insulator which extends into an interior section of the bulb, (b) an electronic control module mounted in the receptacle, and (c) means connected to the electronic control module and through the opening in the dielectric insulator for connecting the electronic control module to the filament wire of the bulb for controlling one or a plurality of bulb lighting functions in response to the operation of the electronic control module.

Another feature of this invention is the provision of a new and improved article of manufacture of the type described in which the electronic control module further includes: (a) a metal housing having a base or floor member surrounded by an upstanding wall member defining an opening in the housing, (b) a substrate mounted on the base member, and (c) bulb lighting control circuitry mounted on the substrate and having a conductive bridge member connected thereto for transmitting control signals from the bulb lighting control circuitry to the filament wire of the light bulb.

Another feature of this invention is a provision of a new and improved electronic control module of the type described which is particularly adapted and well suited for integration into an incandescent light bulb and includes, in combination: (a) an AC triggerable switch mounted on the substrate and connected to the conductive bridge, (b) an integrated circuit (IC) control chip mounted on the substrate and connected to the AC triggerable switch for controlling the conduction time and conduction phase angle thereof, and (c) one or more resistors or capacitors mounted on the substrate and connected to the integrated circuit control chip for setting and establishing the timing functions of the electronic control module.

Another feature of this invention is the provision of data storage means within the electronic control module for storing lighting function control data therein, and selectively adjustable contact means connected to the data storage means. The contact means may, for example, include a plurality of selectively spaced contact pads positioned around the periphery of the electronic control module so that by the angular rotation of the module one of these contact pads may be brought into connection with an operating voltage and thereby activate a selected lighting control function within the data storage means.

Another feature of this invention is the provision of a novel electronic control module of the type described which, in one embodiment of the invention, allows for selected lighting functions to be made either at the time of manufacturing integration into the light bulb or by the ECM module rotational adjustment by the end user.

Another and most significant feature of this invention resides in the fact that the ECM module described herein is positioned in contact with the center terminal of the adjoining light socket, and this center terminal provides excellent heat sinking and cooling of the ECM module. The socket center terminal is the coolest point in the entire assembly and serves as a good low thermal resistance path to heavy gage copper wire outside of the socket to the surrounding ambient. The center terminal of the socket receptacle is on the order of 10–30 times thicker than the thin walled screw shell sleeve previously used for circuit mounting and is normally made of copper, thereby providing a very short thermal path to the outside ambient.

Another feature of this invention is the provision of a process for manufacturing the above-described electronic control module and operating this module in a novel manner so as to provide lighting function control selectivity.

The above objects, features, and many attendant and related advantages of this invention will become more readily apparent from the following description of the accompanying drawings.

BRIEF DESCRIPTION OF THE DRAWINGS

FIGS. 6 is a plan view of the base or floor member of the ECM module illustrating the geometry of the spaced apart electrical contacts on the module. This figure shows how the ECM module may be rotatably adjusted by an end-user within the end of an incandescent light bulb to provide certain selected operational control functions for the bulb, such as duty cycle control, timing, dimming and the like.

DETAILED DESCRIPTION OF THE DRAWINGS

Figure 1:
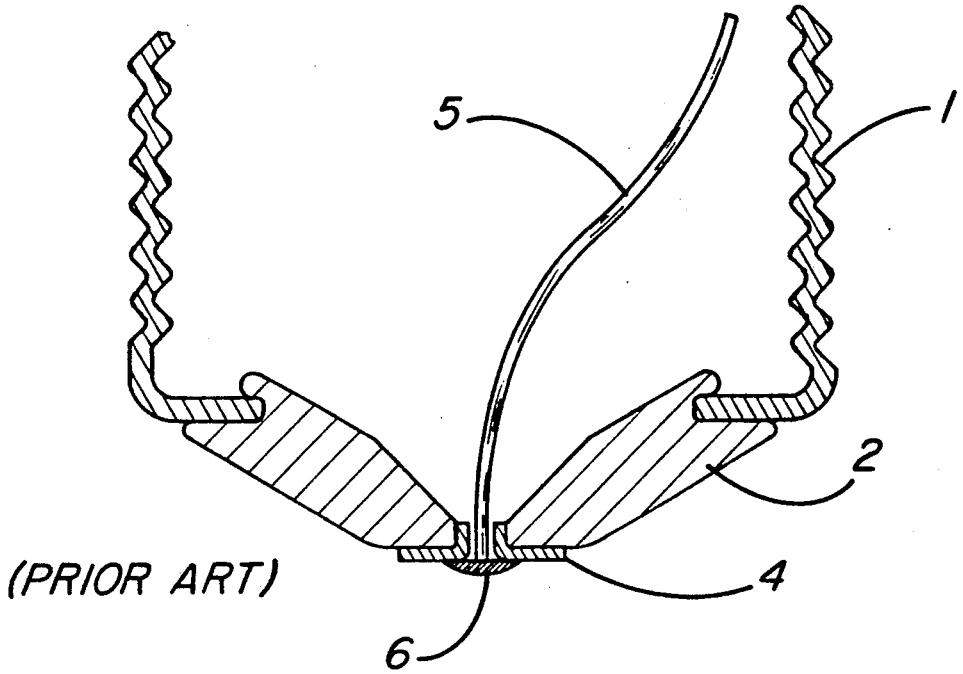
FIG. 1 is a schematic abbreviated cross section view showing a conventional prior art construction of the electrical socket-mating connector section of an incandescent light bulb.

Referring now to FIG. 1, there is shown a typical prior art construction of the end or screw shell section of an incandescent lamp bulb and shown herein in abbreviated and schematic form. This end section will typically include a screw shell sleeve 1 which is affixed to a dielectric insulator member 2 at the small end of the bulb and configured to receive a conductive center terminal 4. The center terminal 4 has a central opening therein as shown through which a filament wire 5 extends, and the filament wire 5 is soldered to the downwardly facing surface of the center terminal 4 by means of a small rounded solder ball or bump 6.

Figure 2:
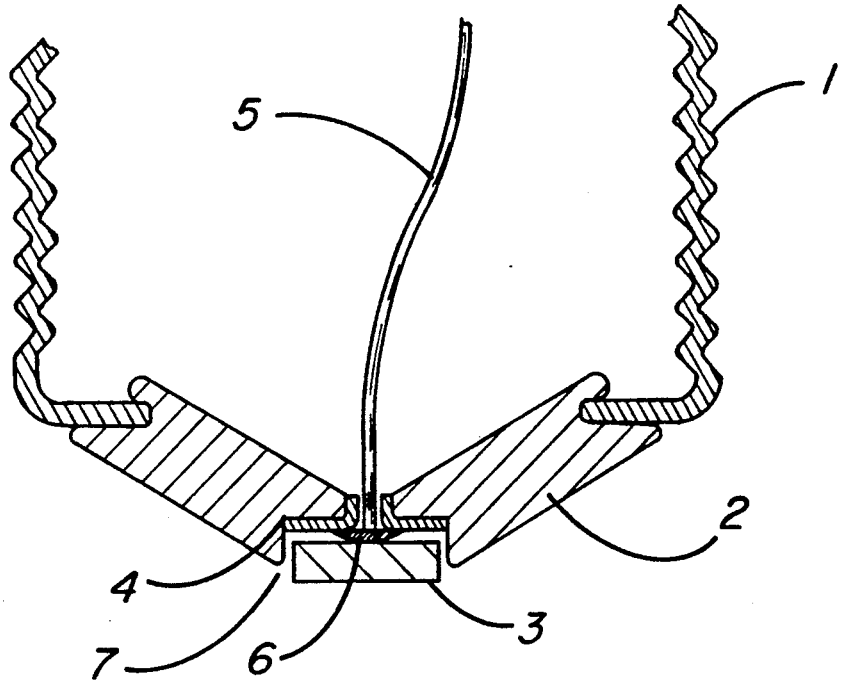
FIG. 2 is a schematic abbreviated cross section view illustrating the manufacturing process and article of manufacture made in accordance with the present invention.

Referring now to FIG. 2, the abbreviated schematic construction shown in this figure is to be contrasted with the prior art construction of FIG. 1 in that the dielectric insulator member 2 of FIG. 2 is now configured to have a recessed cavity or receptacle 7 therein for receiving an electronic control module 3 for making electrical connection to the central terminal 4 and filament wire 5 via the solder bump 6 and using the specific connections described in detail below. It will be appreciated that the present arrangement shown in FIG. 2 of adding the recessed cavity 7 to a standard light bulb manufacturing process is unique in that it does not add any additional steps to the bulb manufacturing process. Instead, only the dielectric forming tool used to mold the soft glass insulation 2 needs a very slight modification to form the recessed cavity 7 in the insulator 2. The lamp bulb to which the screw shell member 1 is attached and all of the high temperature operations of glass molding, insulator molding, high temperature cementing of the screw shell 1 to a glass envelope, and soldering are all completed before the electronic control module 3 is installed in the recessed cavity 7. This installation is then accomplished by the use of a light press fit of the ECM 3 into the cavity 7 prior to the final packaging of the bulb on automated equipment. Thus, the light bulb as shown in FIGS. 3A and 3B herein can be fully aged and tested prior to installing the ECM 3 as described above, and this novel method does not expose the ECM 3 to all of the above high temperature bulb processing steps.

Figure 3B:
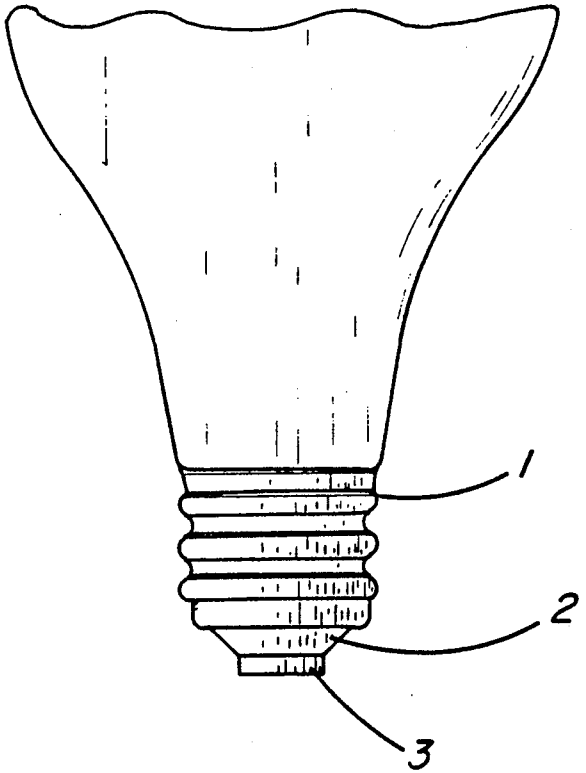
FIG. 3B is an isometric view showing how the end of the incandescent lamp bulb looks with the ECM module mounted therein.
Figure 3A:
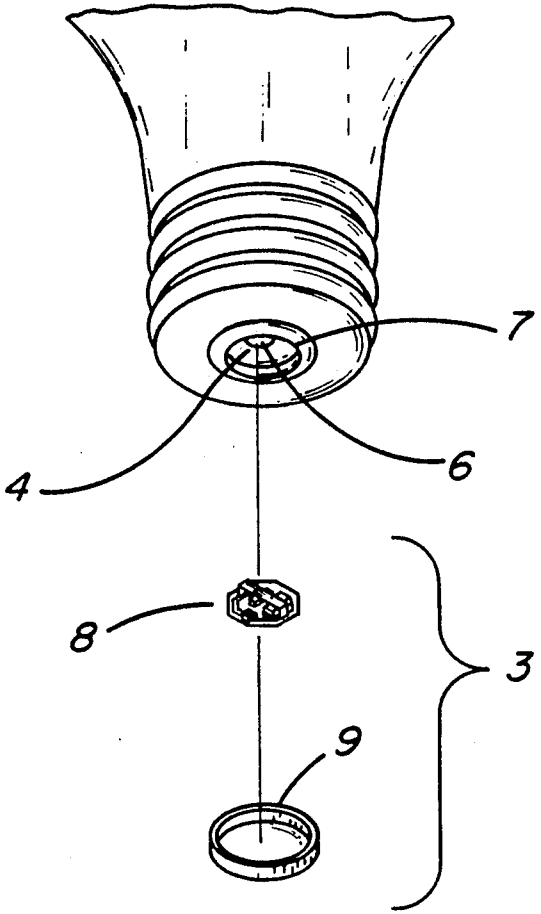
FIG. 3A is an exploded isometric view showing how the electronic control module circuit element fits into its cylindrical container and how these two devices which form the ECM module fit into the end cavity or receptacle of an incandescent lamp bulb.

Referring now to FIGS. 3A and 3B, the electronic control module 3 includes an insulating hybrid-connected substrate 8 carrying ECM control electronics. The ECM substrate 8 is configured in the shape of a hexagon or an approximate circle and is adapted to fit into a cylindrical can or housing 9. When the ECM module substrate 8 is mounted in the cylindrical housing 9, then the housing 9 is inserted into the receptacle 7 of the lamp bulb as shown so that the screw shell end of the lamp bulb in FIG. 3A will now appear as shown in FIG. 3B in the completely assembled view.

Figure 4:
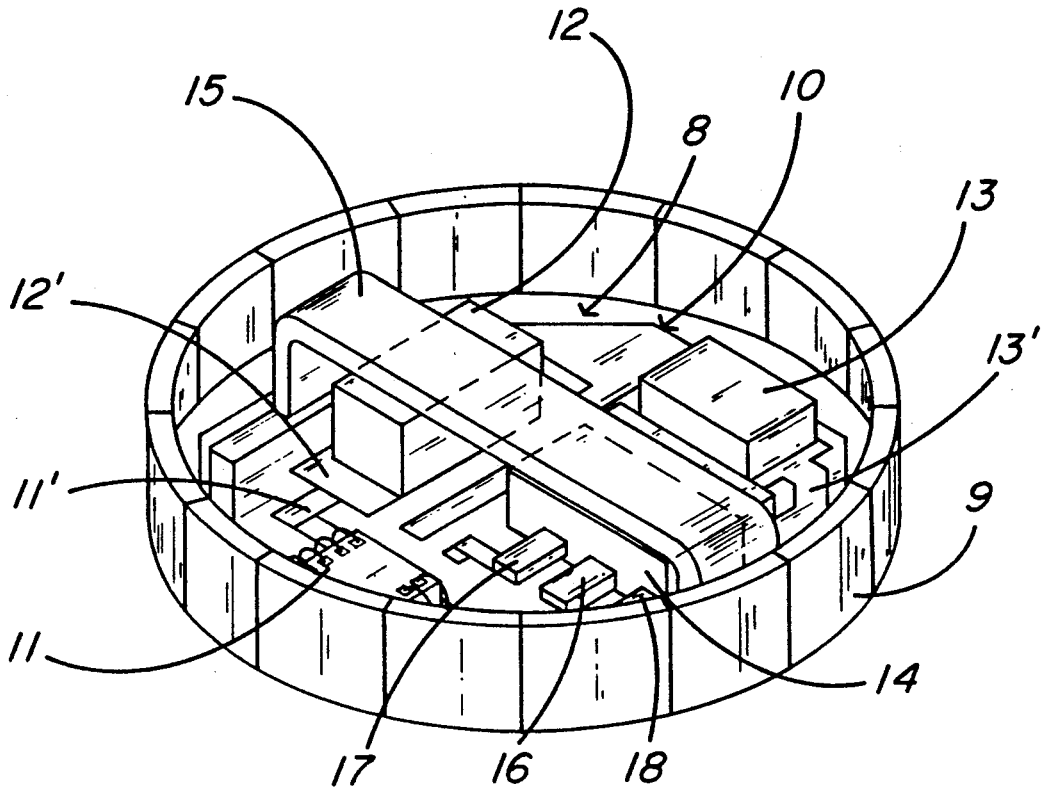
FIG. 4 is an enlarged isometric view of an electronic control module (ECM) made in accordance with the present invention.
Figure 5:
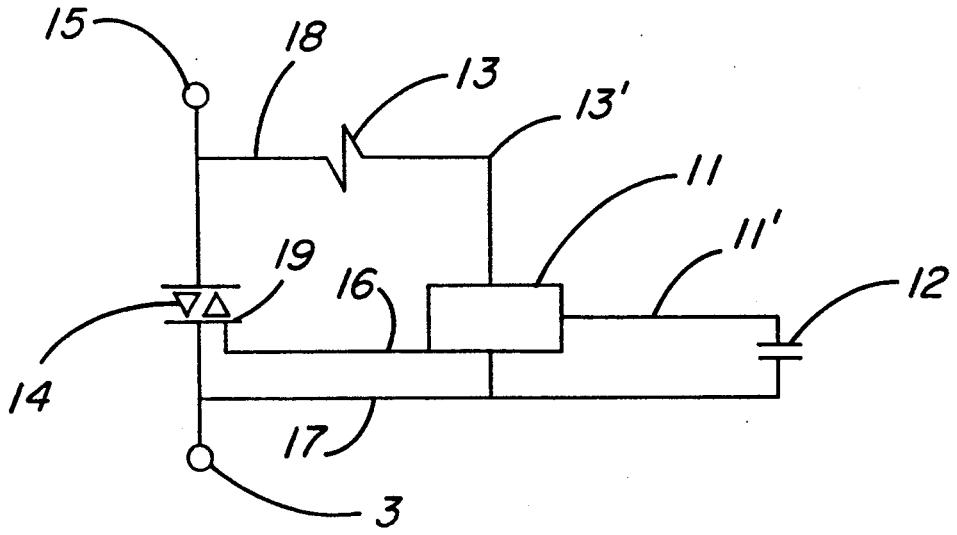
FIG. 5 is an electrical circuit schematic diagram showing the primary electrical connections and associated active and passive electrical components within the ECM module in FIGS. 3A, 3B, and 4 above.

Referring now to FIGS. 4 and 5, the ECM module substrate 8 is defined in part by the outer hexagon shaped substrate sides 10, and the insulating substrate member 8 includes thereon an integrated circuit control chip 11 containing a microprocessor, a chip capacitor 12, and chip resistor 13, an AC controlled power semiconductor device or switch 14, and a conductive bridge member 15. These components 11 through 15 comprise the major or primary components within the ECM module 3, and these components are interconnected using conventional conductive trace patterns and component bonding techniques well known in the art. For example, the phase controlled power switch 14 is connected to receive a control or gate voltage at terminal 16 and to an AC voltage source via terminals 17 and 18. Similarly, the IC chip 11 is connected via conductive trace patterns 11' and 12' to the chip capacitor 12, and the switch 14 is connected to the chip resistor 13 via a conductive trace pattern 13'.

The equivalent electrical schematic circuit showing the connection of these active and passive components is shown in FIG. 5 wherein the power semiconductor device 14 is preferably a semiconductor TRIAC. The TRIAC 14 in FIG. 5 is connected as shown between two terminals 3 and 15 which in turn are connected in series with the filament wire 5 of the incandescent lamp bulb under the control of the TRIAC 14. Thus, the lamp is turned on and the filament wire 5 therein is conducting when the TRIAC 14 is conducting, and the lamp is turned off when the TRIAC 14 is non-conducting.

The states of conduction and non-conduction of the power TRIAC 14 are controlled by a control signal generated on the output line 16 of the microprocessor chip 11, and the microprocessor chip 11 is responsive to the momentary interruption of AC power thereto to generate certain phase controlled signals which are applied to the gate electrode 16 of the TRIAC 14. The phase control operation of the microprocessor chip 11 to control the conduction and switching operation of the TRIAC 14 is described in detail in my above identified patent application Ser. No. 07/354,214. The conductive bridge 15 in the ECM module 3 is directly connected to the upper electrode of the TRIAC 14 and is also electrically connected to one side of the AC supply voltage at the center terminal of the lamp. The cylindrical can 9 of the ECM module 3 is also connected in series with the conductive bridge 15, so that the microprocessor semiconductor chip 11 and its associated control electronics and passive components are also connected in series via chip resistor 13 between the filament wire 5 of the lamp and one side of the AC line voltage.

Figure 6:
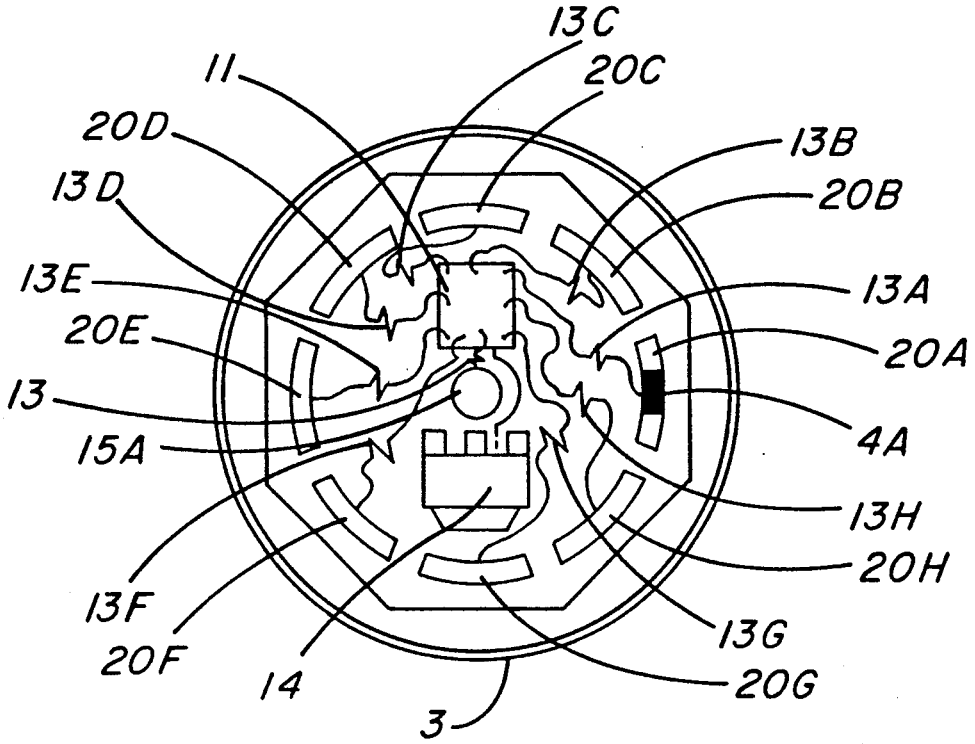

Referring now to the end-user function selectable embodiment of FIG. 6, there are shown eight (8) arcuate shaped electrical contact pads identified as 20A, 20B, 20C, 20D, 20E, 20F, 20G, and 20H. These eight contact pads are electrically connected through a corresponding plurality of resistors 13A–13H to the IC chip 11 and wire bonded at the eight wire bonding sites shown on the upper surface of the microprocessor semiconductor chip 11. The semiconductor chip 11 is connected by way of the substrate mounted resistor 13 to the conductive bridge 15 in FIG. 6, and the bridge terminal 15 supplies AC power to the upper electrode of the TRIAC 14 and to the IC chip 11 as previously described. The other or lower output electrode of the semiconductor power TRIAC 14 is connected through the conductor 17 and through a chip storage capacitor 12 to another input terminal of the microprocessor chip 11, and this connection is seen in more schematic detail in FIG. 7.

The storage capacitor 12 is operative to maintain DC voltage level within the chip 11 above a certain DC operating threshold voltage during periods of momentary interruptions of AC power applied to an AC-to-DC converter (not shown) within the chip 11. The AC voltage at the terminals 3 and 15 and applied via lines 17 and 18 to the IC chip 11 is AC to DC converted by an AC-DC converter within the chip 11 to provide the necessary DC operating bias therefor. The gate or control electrode 19 of the TRIAC 14 is connected via line 16 to another output terminal of the microprocessor chip 11, and the TRIAC 14 is phase-controlled by a microprocessor output control voltage applied to the gate electrode 19 of the TRIAC 14. This phase control operation of the microprocessor chip is described in detail in my above identified copending patent application Ser. No. 07/345,214.

Figure 7:
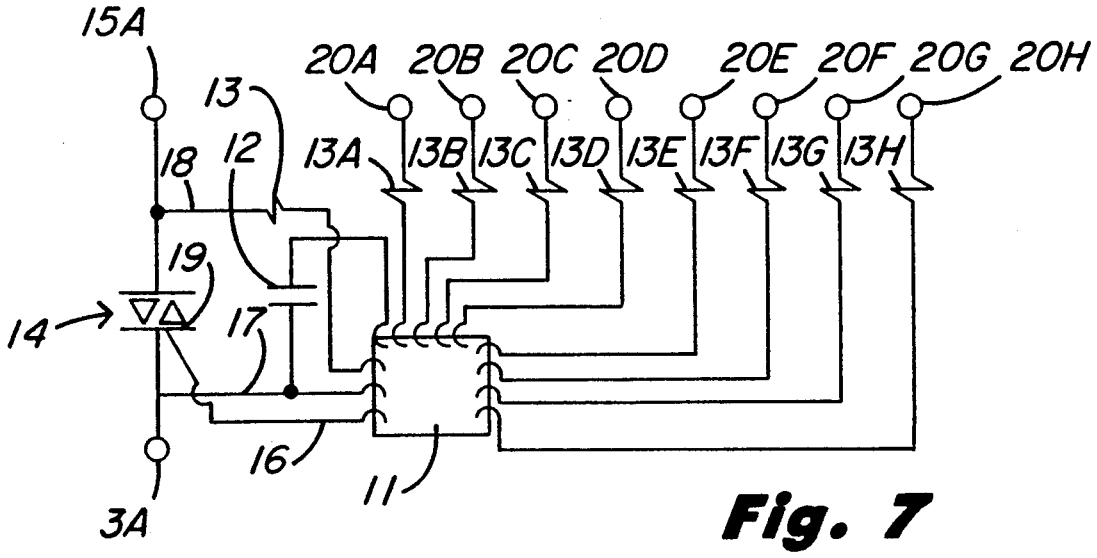
FIG. 7 is an electrical schematic diagram showing how the rotatably selectable control module illustrated in the various figures above, and particularly in FIG. 6, is electrically connected. The end-user-adjustable embodiment of FIGS. 6 and 7 is to be contrasted with the ECM embodiment of FIGS. 4 and 5 above wherein end-user function selectivity is not provided.

Referring now to FIG. 7, it is seen that the rotation of the ECM module 3 to any of its eight arcuate contact positions 20A–20H will operate to interconnect a selected one of these contacts to the center terminal wiper blade or contact 4 of an electrical lamp. This contact selection will in turn connect a selected one of the resistors 13A–13H in parallel with resistor 13 by directly connecting the bridge electrode 15A directly to a selected one of the terminals 20A–20H. Thus, if the wiper contact to the center terminal of the lamp is connected at location 4A in FIG. 6 on the arcuate contact 20A, the resistor 13A will be connected electrically in parallel with the chip resistor 13. Each one of these connections 20A–20H may be connected, for example, into a different ROM memory site within the memory stage of the microprocessor chip 11 and thereby operate as described in may above copending application Ser. No. 07/345,214 to select a particular microprocessor lighting function such as timing, dimming, duty cycle control and the like. Thus, when a wall switch is turned on and off to in turn connect and disconnect AC power to a wall socket (see FIG. 10 below) into which a lamp bulb containing the ECM module 3 is mounted, only one of the contacts 20A–20H and one of the associated resistors 13A–13H are energized so that each of these contacts 20A–20H operates to store the wall switch on-off data into a particular memory site within a read-only memory (ROM) stage located in the microprocessor chip 11.

Figure 8:
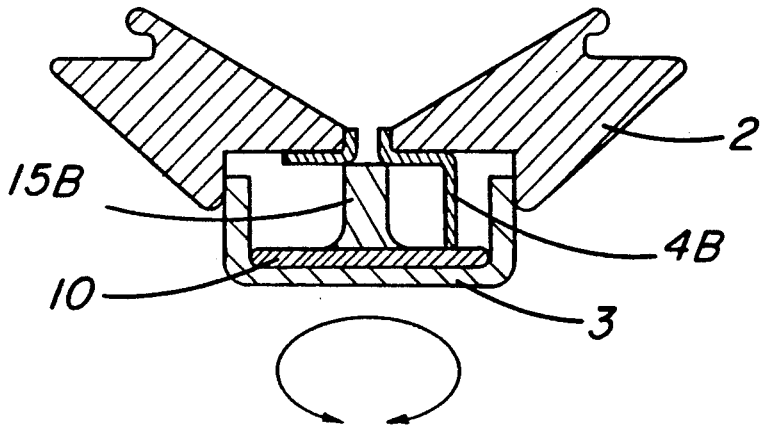
FIG. 8 is an enlarged isometric view of a lamp bulb control terminal useful for operation with the rotatably selectable control module described herein.

Referring now to FIG. 8, this contact selectivity of the eight arcuate shaped contacts 20A–20G as described in FIGS. 6 and 7 above may be provided by means of a wiper contact or blade 4B which, as shown in FIG. 8, extends vertically downward to make electrical contact with the ECM hybrid circuit substrate 8 at one of the eight selected contact positions thereon. As previously indicated, this may be accomplished by the end-user by rotating the ECM substrate and its surrounding can or housing 9 therefor until the contact 4B electrically engages a selected arcuate shaped contact 20A–20H on the ECM substrate 8 as previously described. It will be noted in FIG. 8 that a vertical post 15B has been used to replace the previously described conductive bridge member in the earlier described embodiments.

Figure 9A:
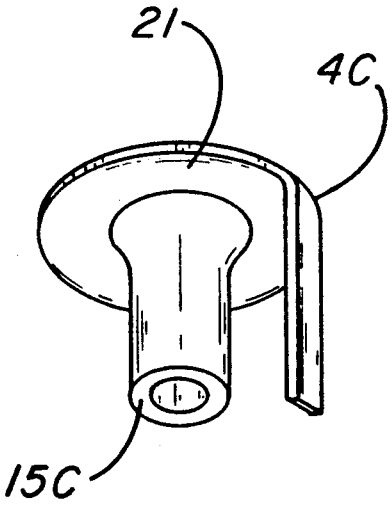
FIG. 9A is an enlarged isometric view of one embodiment and construction for the end terminal, wiper contact and receptacle for the incandescent lamp bulb used herein.
Figure 9B:
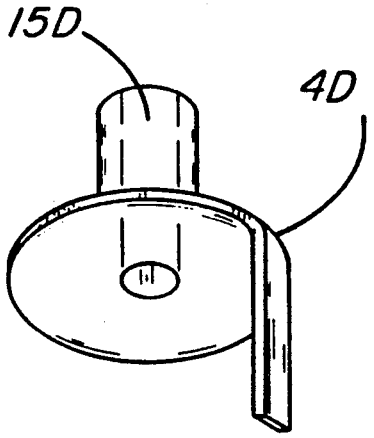
FIG. 9B is an enlarged isometric view of another embodiment and construction for the end terminal, wiper contact and receptacle of the incandescent lamp bulb used herein.

Referring now to FIGS. 9A and 9B, the contact wiper blades 4C and 4D shown in these figures for connecting the ECM module 8 to the center terminal of the incandescent bulb is vertically extended normal to the plane 21 of the terminal. The blade or wiper 4C may be extended in the same direction as the center post 15C as shown in FIG. 9A, or it may be extended in a different and opposite direction from the center post 15D as shown in FIG. 9B.

The various contact selection embodiments shown in FIGS. 9A, 9B, and 9C are most useful to enable the user (consumer) to select a desired lighting function. For example, this contact selection to one of the available terminals 20A through 20H in FIGS. 6 and 7 above will enable a user to select a particular level of a four (4) level dimmer by having four different illumination intensities each operable by a momentary power interruption to the ECM module 3. Alternatively, an emergency flasher may be used for a front porch lamp and be operative to begin flashing a signalling sequence in response to a predetermined set of power interruptions by the user. Or, in the control of a hall light, the contact selection means may be used for automatically dimming the light to a night light setting after the expiration of a prescribed period of time. Or, in the control of a child's nursery light, a control function within the microprocessor 11 in FIG. 7 might be selected to respond to a momentary power interrupt to the ECM 3 to slowly and imperceptibly begin dimming a light to a night light setting.

Figure 10:
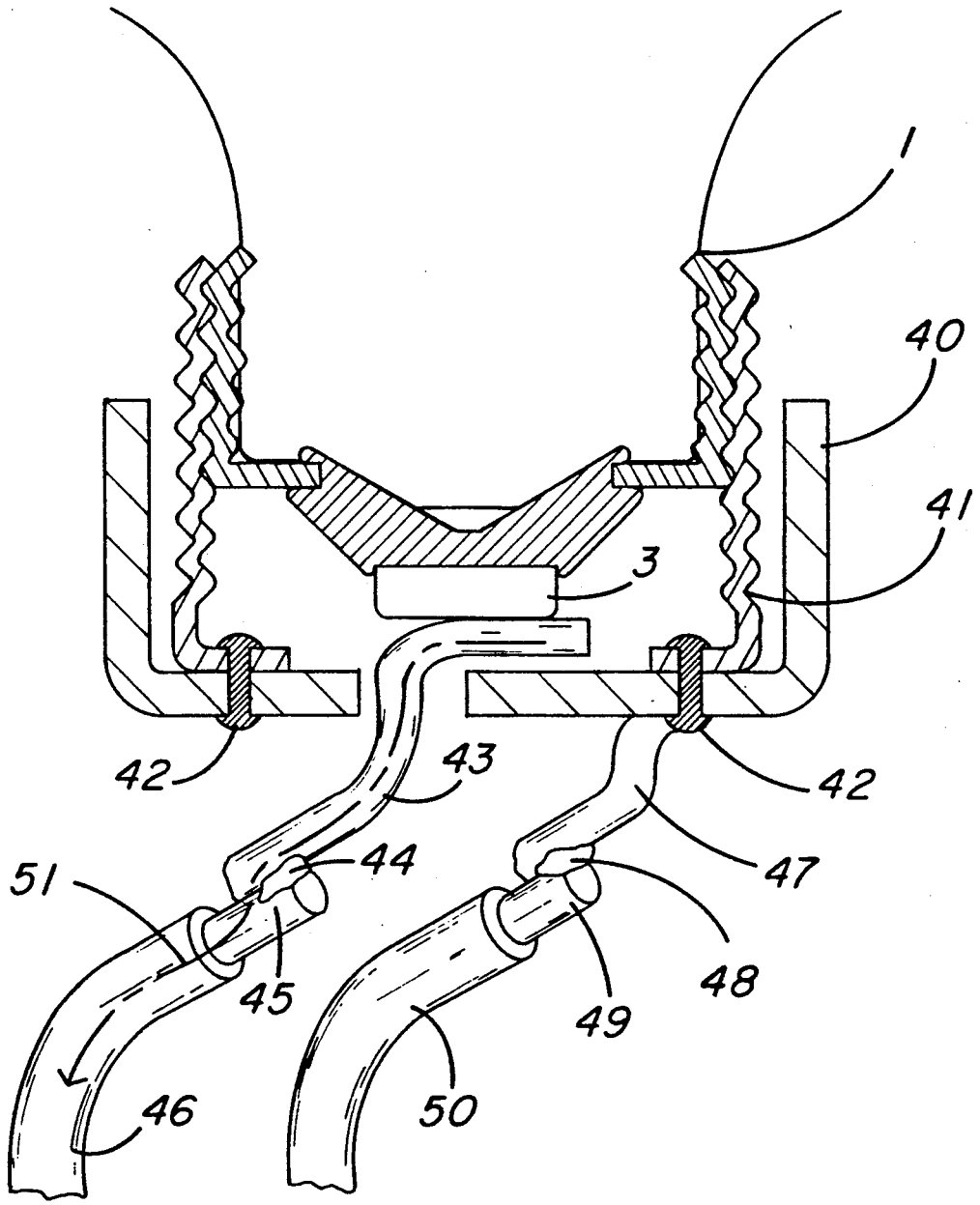
FIG. 10 is a partially isometric and partially cross sectioned view showing a lamp bulb screw shell socket connection which will be typically made to the exterior metal can housing for the electronic control module described below. This connection provides good heat transfer away from the lamp bulb and the ECM mounted therein.

Referring now to FIG. 10, there is shown a combination schematic cross section and partially isometric view of how a lamp and screw shell constructed in accordance with the present invention will be mated into an electrical receiving socket of conventional construction. The lamp screw shell 1 is adapted to be received by a mating outer socket shell 41 which is in turn surrounded by a bulb socket housing 40 and secured thereto by means of a pair of permanently bonded bolt fixtures 42. The ECM module 3 is adapted to abut directly against the surface of a central conductor 43 which is in turn solder bonded by a suitable solder material 44 to an exposed cable end 45 of a first electrical cable 46. The conductive exposed end 45 of the cable member 46 serves to electrically interconnect the ECM module 3 and the lamp bulb filament in series with one terminal of an AC line via an external home wall switch or the like.

Another second conductor 47 is bonded as shown between the socket housing 40 and a solder connection 48 which is located between the conductor 47 and an exposed conductor end 49 of the second cable 50. The conductor 47 provides a ground connection for the housing 40 and shell 41 and completes the AC circuit for the ECM module 3 and lamp filament 5. The dot and dashed line 51 as indicated in FIG. 10 and extending down the center of the conductors 43 and 45 provides a good heat conductive and thermal transfer path for the heat generated in the ECM module 3 and away from the lamp bulb insulator and receptacle in which the ECM module 3 is mounted. Thus, quite unlike the prior art as exemplified by Vernooij et al. in U.S. Pat. No. 4,644,226, not only is the ECM module 3 exposed to a minimum of temperature cycling and exposure from the lamp bulb manufacturing process per se, but in addition and after the ECM module 3 has been mounted as shown in the end insulator receptacle of the lamp, the heat transfer capability for the socket mounted lamp is completely optimized. This feature serves to provide a maximum of heat conduction away from the lamp bulb and ECM module 3 as shown, and this feature in turn serves to optimize both the reliability of operation and the useful lifetime of both the ECM module 3 and the lamp to which it is connected.

Various modifications may be made in and to the above described embodiments without departing from the spirit and scope of this invention. For example, the circuit connections shown in FIGS. 6 and 7 may be widely varied in accordance with the required number of microprocessing functions of the IC chip 11 used to control lighting functions such as dimming, timing, duty cycle variations and the like. Furthermore, the size, shape and geometry of the hybrid circuit substrate 8 and housing 9 which together comprise the ECM module 3 may also be widely varied in accordance with changes to the circuit designs shown in FIGS. 6 and 7 herein. Accordingly, it is to be understood that such various modifications and obvious choices in both electrical and mechanical design are clearly within the scope of the following appended claims.

I claim:

1. An electronic control module constructed for insertion into a recessed cavity in a dielectric insulator member of the screw shell base of a lamp bulb just prior to the final packaging of the bulb and avoiding module exposure to high temperature bulb processing steps, including in combination:

a. a metal housing having a base member surrounded by an upstanding wall member defining an opening for said housing, b. a hybrid substrate mounted on said base member, and c. bulb lighting control circuitry mounted on said substrate and including thereon a programmable integrated circuit control chip containing control logic, said control circuitry having a conductive member connected thereto for transmitting control signals from said bulb lighting control circuitry to a filament wire within said light bulb, whereby said electronic control module operates a control one or more lighting functions of said bulb.

2. The electronic control module defined in claim 1 wherein said bulb lighting control circuitry includes:

a. data storage means therein containing lighting function control data for controlling at least one lighting functions of said bulb, and b. a plurality of function-select lines and terminals connected between said data storage means and a plurality of separate contact pads on said electronic control module, whereby said electronic control module may be rotated within said dielectric material to a predetermined angular position and thereby connect one of said contact pads to DC operating voltage sufficient to activate a chosen lighting function control data within said data storage means.

3. The electronic control module according to claim 1 which further includes:

a. an AC triggerable switch such as a semiconductor TRIAC mounted on said substrate and connected to said conductive bridge, and b. said integrated circuit control chip containing a microprocessor connected to said AC triggerable switch.

4. The electronic control module according to claim 2 which further includes:

a. an AC triggerable switch such as a semiconductor TRIAC mounted on said substrate and connected to said conductive bridge, and b. said integrated circuit control chip connected to said AC triggerable switch.

5. The electronic control module according to claim 4 wherein said substrate further includes at least one resistors or capacitors mounted thereon and connected to said integrated circuit control chip for establishing the timing or other operational functions of said electronic control module.

6. A process for manufacturing an electronic control module constructed for integration into a recessed cavity in a dielectric insulator member of the screw shell base of a lamp bulb just prior to the final packaging of the bulb and avoiding module exposure to high temperature bulb processing which includes the steps of:

a. stamping a metal can housing to a chosen height and width suitable for being press fitted into a dielectric end section of an incandescent lamp bulb, b. mounting a hybrid substrate assembly on the bottom floor of said housing, with said substrate containing control electronics thereon for controlling various lighting functions of said lamp bulb, said control electronics including thereon a programmable integrated circuit control chip containing control logic, and c. connecting a conductive member to said control electronics and adjacent to an open end of said housing so that it may be electrically connected to an end terminal of said lamp bulb when said metal can housing is inserted into said dielectric end section thereof at the conclusion of bulb manufacture.

7. The process defined in claim 6 which further includes operating said electronic control module by:

a. providing a plurality of lighting function select contacts on said substrate assembly and operative to connect an operating voltage to a selected data storage cite within said assembly, and b. rotating said metal can housing or said substrate assembly therein to a predetermined angular position to thereby connect one of said lighting function select contacts to said operating voltage.

* * * * *